US005287799A

United States Patent [19]

Pickering et al.

[11] Patent Number: 5,287,799

[45] Date of Patent: Feb. 22, 1994

[54] RECESSED COOKTOP APPLIANCE SYSTEM

[75] Inventors: Mark A. Pickering, Lebanon; Richard W. Brangan, Greenwood, both of Ind.

[73] Assignee: Maytag Corporation, Newton, Iowa

[21] Appl. No.: 794,482

[22] Filed: Nov. 19, 1991

Related U.S. Application Data

[63] Continuation-in-part of Ser. No. 704,644, May 23, 1991.

[51] Int. Cl.[5] ..... A47J 27/12; A47J 37/00; F24C 7/04; F24C 7/06

[52] U.S. Cl. ..... 99/446; 99/444; 126/1 R; 126/211; 219/443

[58] Field of Search ..... 99/339, 400, 425, 444–446, 99/448, 450, 340; 126/37 R, 39 R, 41 R, 211, 299 R, 300, 299 E, 299 C, 299 D, 214 R; 219/443, 445, 460, 461, 467

[56] References Cited

U.S. PATENT DOCUMENTS

| | | | |
|---|---|---|---|
| D. 152,596 | 2/1949 | Covey . | |
| D. 153,977 | 5/1949 | Porter . | |
| D. 160,951 | 11/1950 | Kruck . | |
| D. 313,532 | 1/1991 | Smith | D7/363 |
| 2,411,464 | 11/1946 | Reeves | 126/39 |
| 2,536,513 | 1/1951 | O'Keefe | 126/39 |
| 2,647,990 | 4/1954 | Burg | 126/214 |
| 3,059,632 | 10/1962 | Rogers | 126/37 |
| 3,444,805 | 5/1969 | Happel et al. | 99/340 |
| 3,474,724 | 10/1969 | Jenn | 99/340 |
| 3,587,555 | 6/1971 | Cerola | 126/300 |
| 3,596,650 | 8/1971 | Cerola | 126/37 R |
| 3,712,819 | 1/1973 | Field | 99/446 |
| 3,745,912 | 7/1973 | Field | 99/447 |
| 3,797,375 | 3/1974 | Cerola | 219/460 |
| 3,941,043 | 3/1976 | Cerola et al. | 99/339 |
| 4,042,806 | 8/1977 | McCartney | 219/460 |
| 4,291,668 | 9/1982 | Moeller | 126/41 R |
| 4,361,132 | 11/1982 | Adkins | 126/221 |
| 4,413,610 | 11/1983 | Berlik | 126/39 K |
| 4,562,827 | 1/1986 | Cerola | 126/299 R |
| 4,634,841 | 1/1987 | Laughrey | 219/464 |
| 4,736,729 | 4/1988 | Beach | 126/39 R |
| 4,821,704 | 4/1989 | Tucker et al. | 126/299 D |
| 4,862,795 | 9/1989 | Hawkins | 99/446 |
| 4,962,694 | 10/1990 | Graver | 126/37 R |
| 5,001,970 | 3/1991 | Graver | 99/339 |

FOREIGN PATENT DOCUMENTS

| | | | |
|---|---|---|---|
| 0156586 | 5/1978 | Netherlands | 99/446 |
| 2159041 | 11/1985 | United Kingdom | 99/446 |
| 2214063 | 8/1989 | United Kingdom | 99/446 |

*Primary Examiner*—Timothy F. Simone

*Attorney, Agent, or Firm*—Willian Brinks Olds Hofer Gilson & Lione

[57] ABSTRACT

A countertop cooking unit provides an upper surface that is level with the countertop and has removable interior parts that are exposed to the residues of cooking operations. A cooktop housing is supported by the countertop and forms a burner box having an open top level with the countertop. A removable drip pan is recessed below the open top of the housing within the burner box and is removably carried by the housing at its peripheral edges. A downdraft ventilation plenum is recessed below, and includes an air flow opening below, the open top of the housing and is carried, at least in part, by the burner box, and at least one heating unit is recessed and removably carried within the removable drip pan. In grilling units, a removable grill pan liner is recessed within, and removably carried by, the drip pan at its peripheral edge and removably carries a grill heater recessed within its periphery. The countertop cooking unit provides substantially reduced heat transfer to the countertop during cooking operations, in part as a result of a plurality of air flow openings at the periphery of the removable drip pan.

28 Claims, 9 Drawing Sheets

RECESSED COOKTOP APPLIANCE SYSTEM

CROSS-REFERENCE TO RELATED APPLICATIONS

This application is a continuation-in-part of pending design patent application Ser. No. 07/704,644 filed May 23, 1991.

1. Field of the Invention

This invention relates to a system for providing cooking appliances adapted to be carried by a countertop and countertop cooking appliances providing downdraft ventilation, and, more particularly, relates to countertop cooking appliances that may be recessed within the countertop and provide a decorative upper surface in the plane of the countertop, substantially reduced heat transfer to the countertop during use of the appliance, and easily removable and variable components.

2. Background of the Invention

Cooking appliances have been the subject of years of development and many patents.

U.S. Pat. No. 4,291,668 discloses an apparatus for ventilating an indoor grill by providing ventilating inlets above the grill surface to draw smoke away from the grill.

U.S. Pat. No. 4,413,610 discloses a gas surface range having modular burner cartridges and a downdraft ventilation system. In the range of the '610 patent, the burner cartridges can be removed for repairing, cleaning or changing the range top configuration between heating units for a grill and heating units for conventional surface burners. It is adapted for use as a countertop built-in unit by lowering into a rectangular opening in the countertop until an extending perimeter lip of the range contacts the countertop adjacent to the opening to provide support for the range.

U.S. Pat. No. 4,562,827 discloses a downdraft countertop cooking range having an improved ventilation system for removing smoke and cooking odors from the cooking area by providing an open cooking surface recessed substantially below the countertop with exhaust openings above the cooking surface and below the countertop and extending along each side of the cooking surface. The cooktop unit of the '827 patent includes modular grill and surface top cooking units between the exhaust openings of the downdraft ventilation system.

U.S. Pat. No. 4,736,729 discloses a gas downdraft range provided with an air flow system for inducing and maintaining cooling air flow, combustion air flow and exhaust air flow. A housing defines an upwardly facing burner box and a cover overlies the housing with a downwardly formed burner pan disposed within the burner box. The bottom wall of the burner pan is spaced above the bottom wall of the burner box to form an air space therebetween, and the burner box has cooling air inlets and cooling air outlets in communication with the air space to define a cooling air flow path. A downdraft ventilation system is provided centrally within the range and its operation induces and maintains the cooling air flow, combustion air flow and exhaust air flow.

U.S. Pat. No. 4,821,704 discloses a cooking apparatus ventilation system to evacuate smoke and vapors and allow indoor cooking. In the '704 patent, air is evacuated through ventilation channels which surround all but one side of the cooking surface and a layer of air is directed from the fourth side of the cooking surface to push smoke and vapor into the ventilation channels.

U.S. Pat. No. 4,862,795 discloses a cooktop grill for indoor grilling which includes an integrally formed sheetmetal reflector pan interposed between the grill member and the drip pan. The reflector pan has a bottom wall which extends beneath the heating element and four generally upwardly extending side walls to shield the area laterally adjacent the grill area from the radiant heat of the heating element. The reflector pan is configured between its corners to define an air gap between the reflector pan and the adjacent cooktop which provides an air flow path between the area above the cooktop and the area between the drip pan and the reflector pan. When the heating element of the grill is energized, cooling air is drawn by convection from above the cooktop downwardly through the air gap into the area between the drip pan and the reflector pan and upwardly through narrow slots in the bottom of the reflector pan.

U.S. Pat. Nos. 2,411,464; 2,536,513; 2,647,990; and 3,059,632 disclose cooking stoves with hinged covers over their cooking surfaces. U.S. Pat. Nos. 152,596; 153,977; and 160,951 disclose modular cooktop covers disposed above the plane of the cooking surface. U.S. Pat. No. 4,361,132 and U.S. Pat. No. 313,532 also disclose modular covers disposed above the plane of the cooking surface and having handles and knobs.

None of the above exemplary patents, nor, it is believed, other prior art teaches countertop cooking apparatus having features that permit it to be recessed within a countertop and provide a decorative upper surface level with the countertop, substantially reduced heat transfer to the countertop during its operation and easily removable elements permitting variation in its configuration, convertibility between various cooking operations and easy cleaning.

SUMMARY OF THE INVENTION

The invention provides a countertop cooking unit or appliance providing an upper surface that is level with the countertop and removable interior parts that are exposed to the residues of cooking operations. In the invention, a housing is adapted to be supported by the countertop and form a burner box having an open top level with the countertop, a bottom and peripheral walls. At least one removable drip pan is recessed below the open top of the housing within the burner box and is removably carried by the housing at its peripheral edges. At least one heating unit is recessed and removably carried within the removable drip pan. In embodiments with downdraft ventilation, a downdraft ventilation plenum is recessed below the open top of the housing and is carried, at least in part, by the burner box. A cooking unit of the invention may be provided with any of a variety of modular surface burner units and grilling units.

In grilling units, the countertop cooking unit further comprises a removable grill pan liner recessed within and removably carried by the drip pan at its peripheral edge. The removable grill pan liner is adapted to removably carry the grill heater recessed within its periphery. In grilling units, the grill heater, grill liner and drip pan are nested within each other, and each is removably carried by the unit housing thereby permitting each element exposed to cooking residues to be easily removed from an installed unit for cleaning, for example by a dishwasher.

A countertop cooking unit of the invention also provides a combination of elements substantially reducing heat transfer to the countertop during cooking operations. In a preferred embodiment of the invention, the removable drip pan comprises an outwardly extending flange around its periphery. The outwardly extending flange is provided with a plurality of distributed air flow openings and engages the housing around its periphery to removably support the drip pan in the housing. In downdraft embodiments, a wall of the downdraft ventilation plenum below the open top and above the bottom of the housing has at least one air flow opening so that a fan induced flow of air into the plenum is directed between the peripheral walls and bottom of the housing and removable drip pan to reduce heat transfer to the housing. To further reduce heat transfer from the drip pan to the housing, the housing can comprise a peripheral flange-forming member with an interior ledge above the burner box, and the outwardly extending flange of the drip pan can rest on and be removably carried by the ledge of the flange-forming member. The plurality of air flow openings can be distributed in the three sides of the drip pan adjacent the countertop, and the outwardly extending flange can be provided with a plurality of downwardly extending feet to reduce the area engaging the ledge and reduce conductive heat transfer from the drip pan to the housing.

When a countertop cooking unit of the invention is adapted for grilling, the removable grill pan liner carries the grill heater and further reduces heat transfer from the grill heater to the unit housing. To accept the grill pan liner, the removable drip pan has a ledge formed in its peripheral walls, and the grill pan liner is provided with outwardly extending corner flanges adapted to rest on the ledge of the drip pan to removably carry the grill pan liner in the drip pan and to reduce heat transfer from the grill heater and grill liner to the drip pan and housing.

In preferred grilling units of the invention, the heater is formed by a serpentine electrical strip heater lying substantially in a horizontal plane and connected through openings in the side walls of the grill liner and drip pan to a connector below the horizontal plane of the heater. The electrical strip heater includes inactive connector portions extending from the connector below the horizontal plane and then upwardly through a transition to provide active heating portions lying closely adjacent each other at each end of the serpentine heating portion and providing uniform heat in the horizontal plane without dead spots adjacent the connector.

A countertop cooking unit of the invention can further comprise a control box attached to a peripheral wall of the housing having an upper surface level with the open top of the housing and carrying one or more controls for the one or more heating units, and any downdraft ventilation system, of the countertop cooking unit. In addition, the countertop cooking unit can be provided with one or more covers for the heating units removably carried within the housing and providing a smooth upper surface level with the countertop. The housing can comprise a peripheral flange-forming member carrying the burner box with supporting surfaces inside its periphery for the removable drip pan and with an outwardly extending flange adapted to carry the cooking unit on the countertop and to provide a decorative trim around the housing level with its open top. The control box can also include a trim strip arranged at its periphery to match the outwardly extending trim portion of the housing flange-forming member.

Other features and advantages of the invention will be apparent from the drawings and more detailed description that follows.

BEST MODE OF THE INVENTION

The above figures illustrate various embodiments of the invention. The invention may be incorporated into "single" units, examples of which are shown in FIGS. 1–6, 9 and 10 and in "double" units, an example of which is illustrated in FIG. 7.

Figure 1:
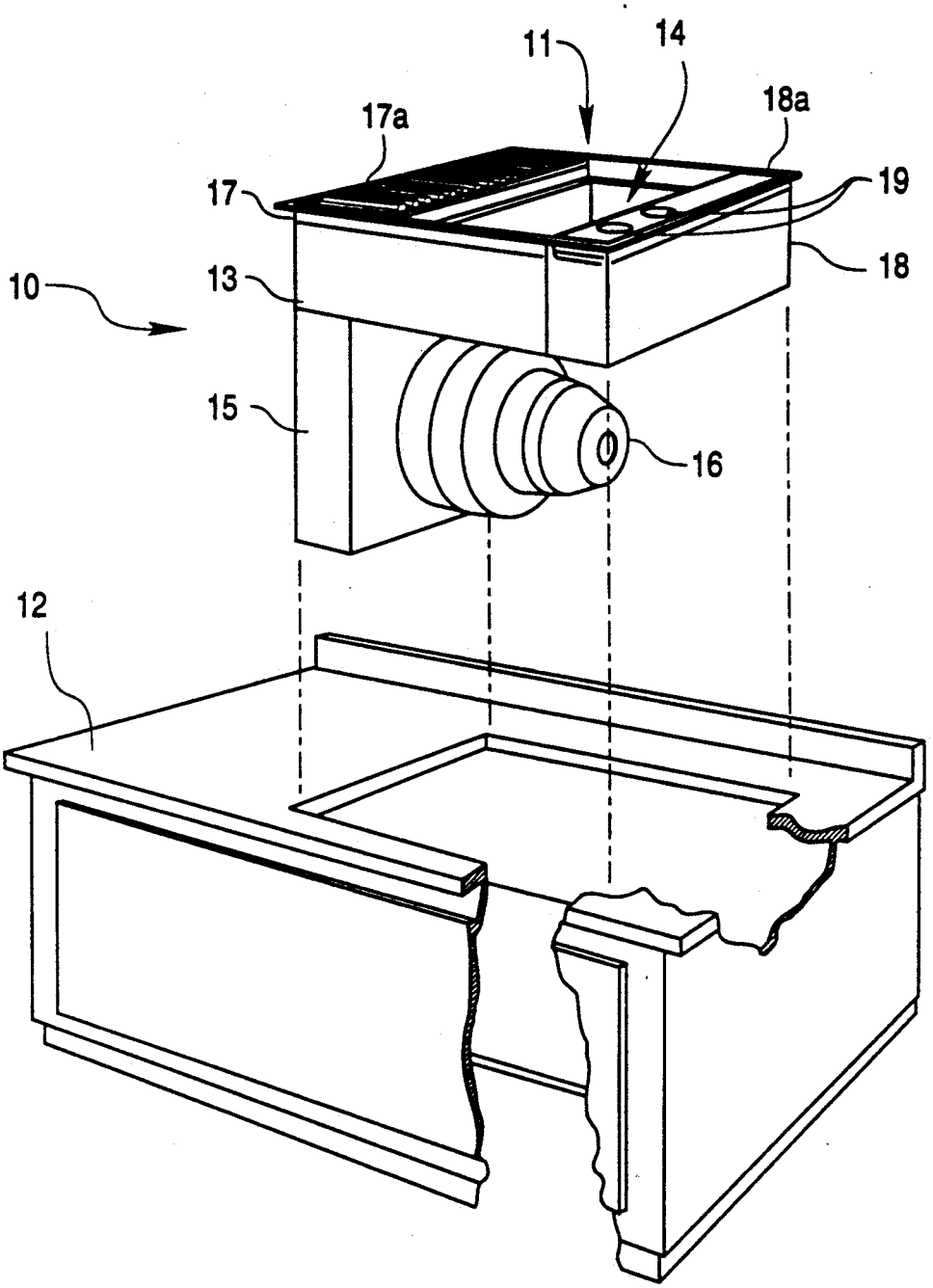
FIG. 1 is a perspective view of a countertop cooking appliance of the invention adapted as a "single" downdraft unit with a control module, illustrating the mounting thereof in a countertop.
Figure 6:
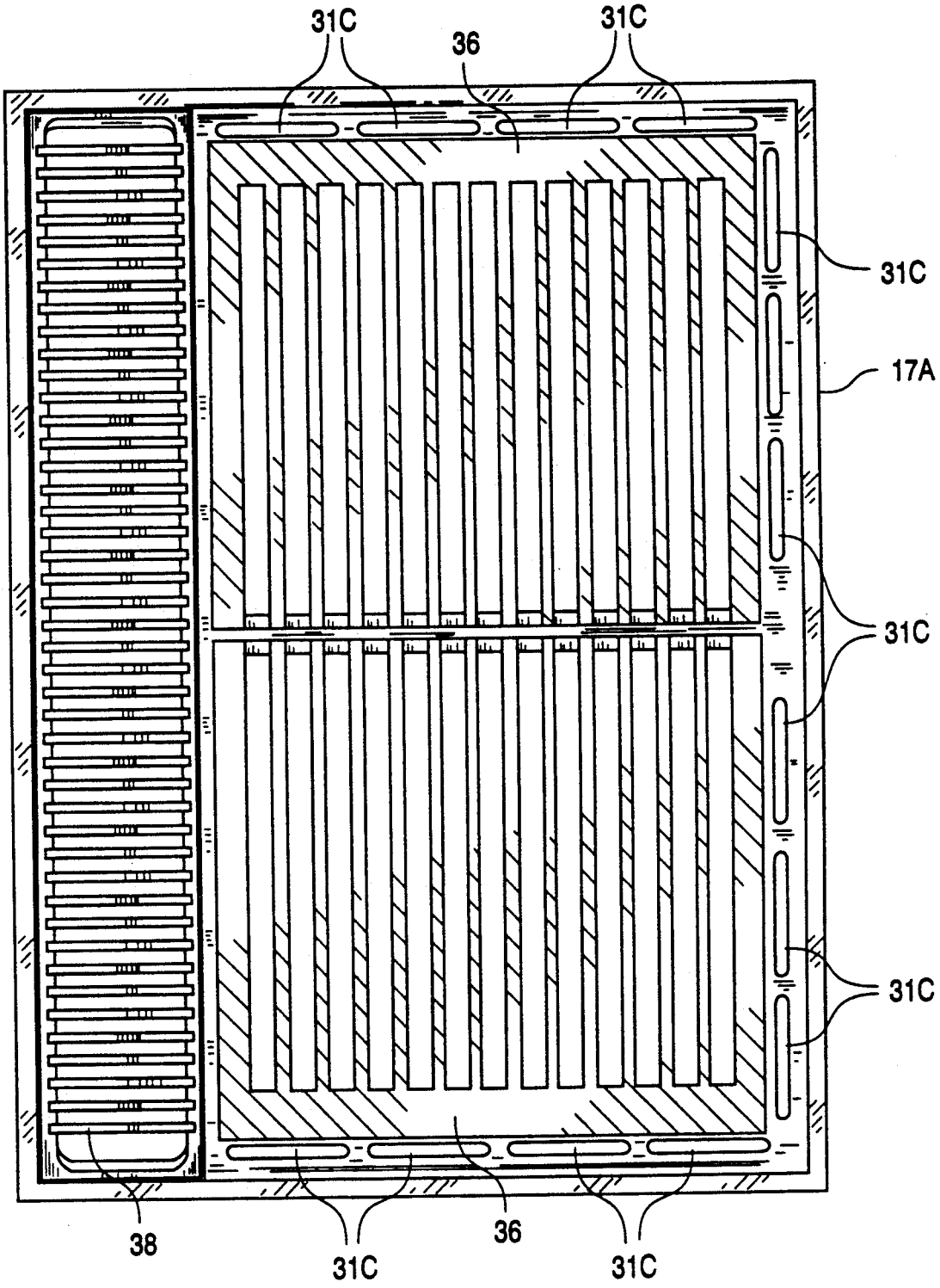
FIG. 6 is a top view of a countertop grilling unit of the invention.
Figure 7:
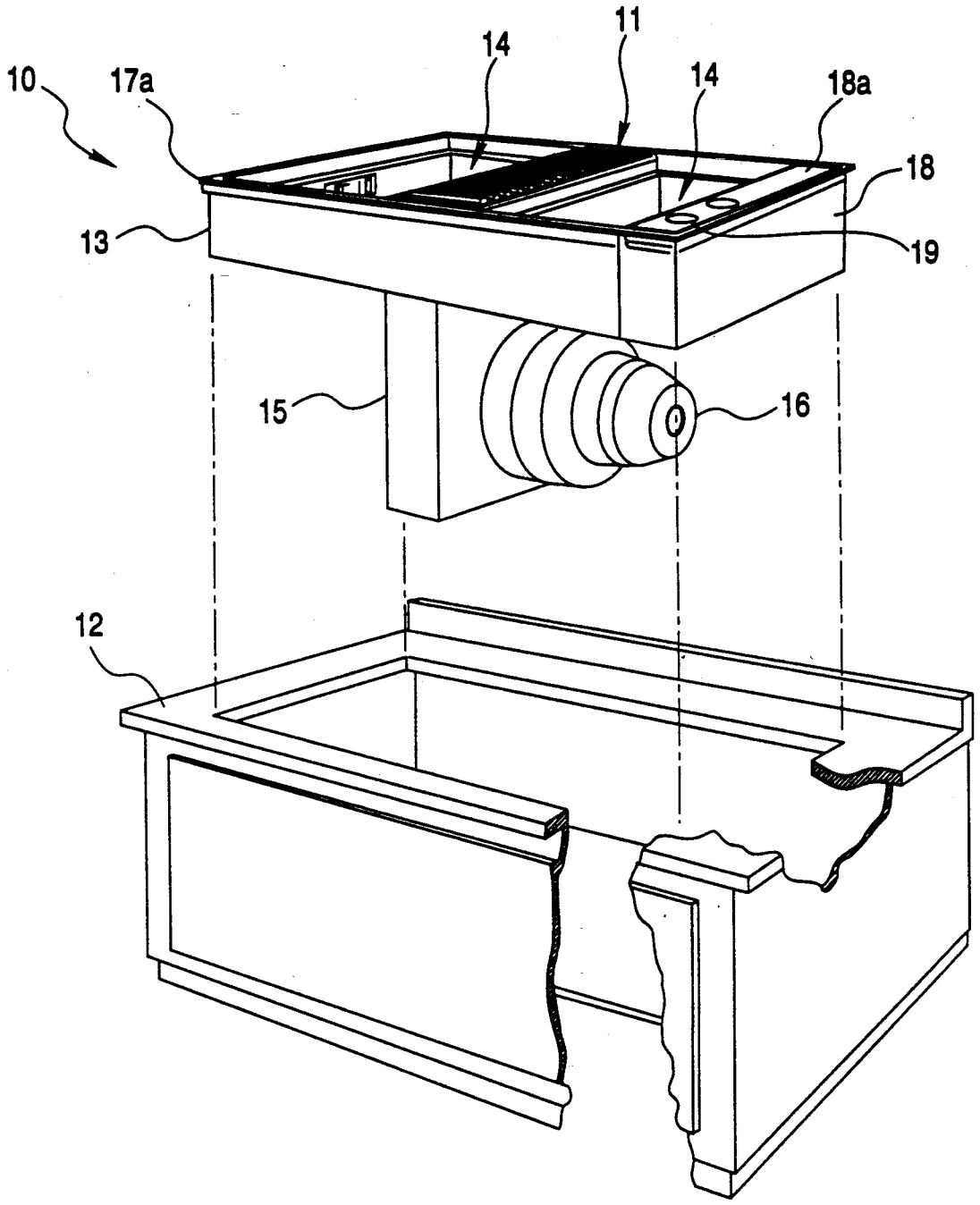
FIG. 7 is a perspective view of a "double" downdraft unit of the invention including a control module illustrating the mounting thereof in a countertop.

FIGS. 1 and 7 show exemplary downdraft embodiments of the invention without the interior parts that are exposed to cooking residues. One feature of the invention is that it permits all interior parts of the countertop cooking apparatus to be easily removed from the apparatus for cleaning and where such interior parts are provided with detergent resistant coatings, they may be cleaned, for example, in a household dishwasher. Another feature of applicant's invention is the modularity that permits an installed unit to be convertible to many uses through the use of various modular heating units in an installed unit. Such modular units can include, for example, surface cooking units, including halogen cartridges, radiant cartridges, cast-iron solid elements and conventional electric coils. In addition, the single units, or one or both sides of the a double unit, may be easily converted for a grilling unit as illustrated, for example, in FIG. 6.

Referring now to FIG. 1, one embodiment of a countertop cooking unit or appliance 10 of the invention is illustrated removed from a supporting countertop 12. The countertop cooking unit comprises a housing 11 adapted to be supported by the countertop 12 and forming a burner box 13 having an open top 14, a bottom (not shown) and peripheral walls. The countertop cooking unit 10 also includes a downdraft ventilation plenum 15 connectible with a fan or blower 16 to provide downdraft ventilation of the cooking operations performed with the unit.

Figure 2:
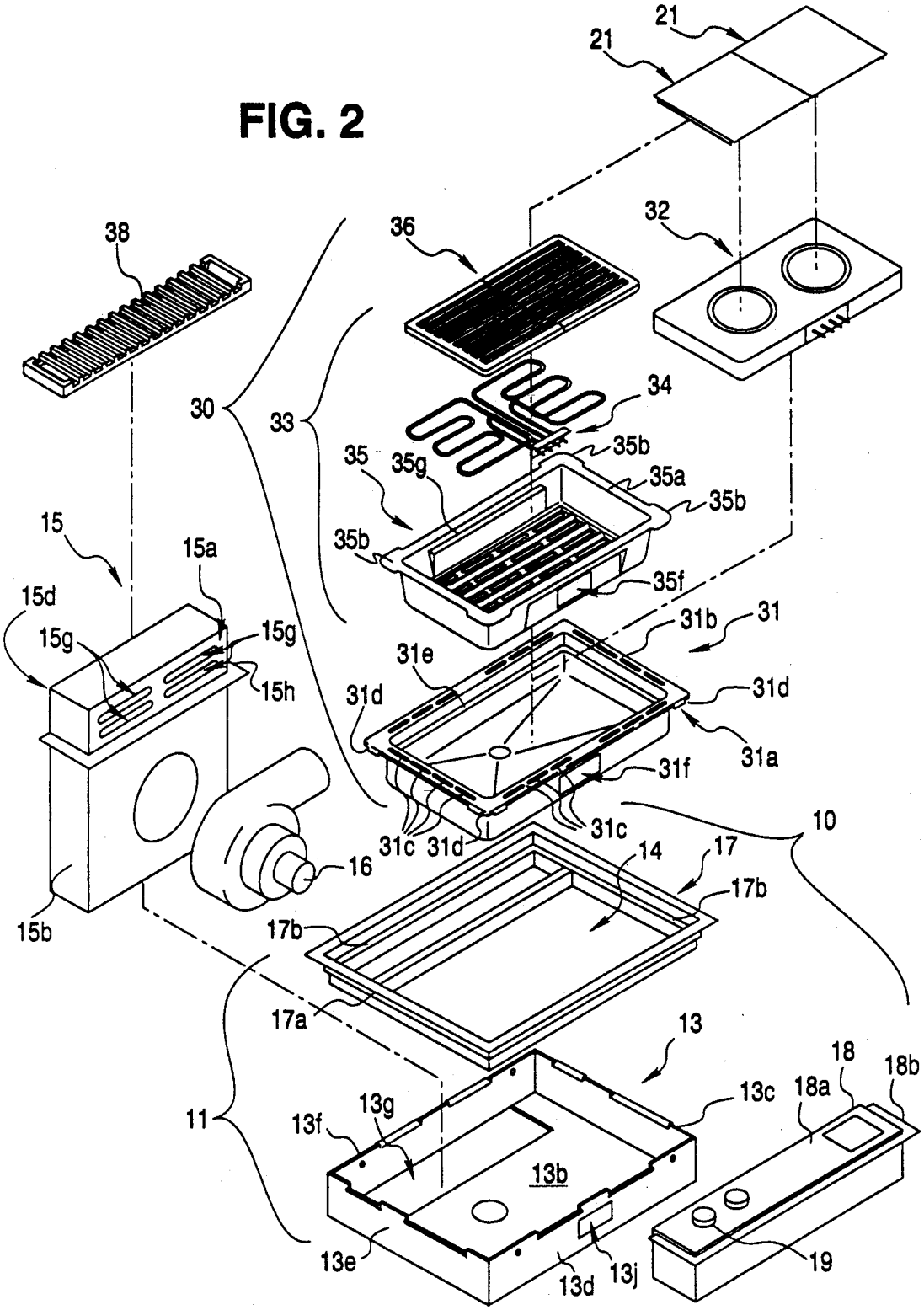
FIG. 2 is an exploded perspective view of the unit of FIG. 1.
Figure 3:
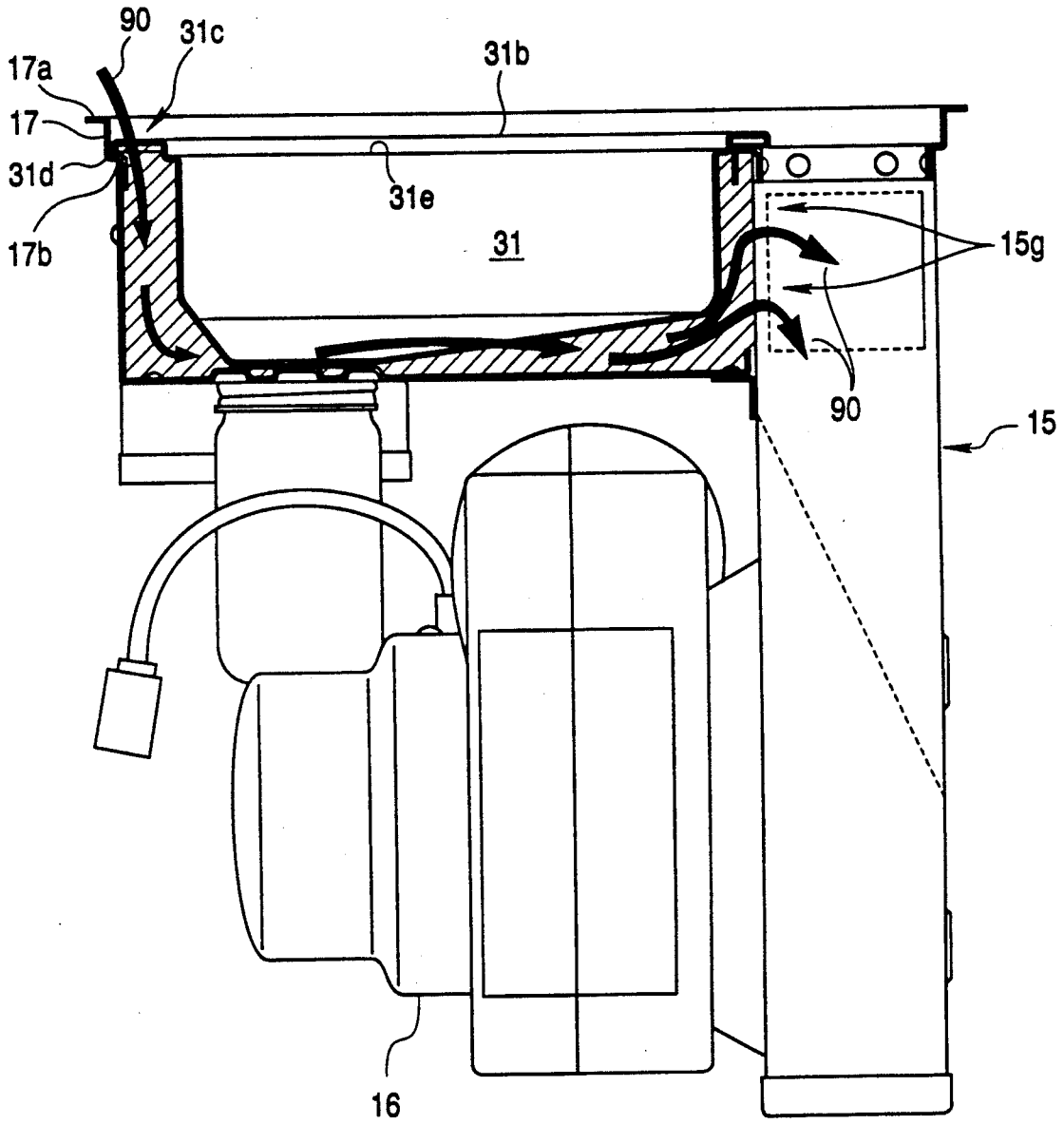
FIG. 3 is a cross-sectional view of the unit of FIG. 1 taken in a plane traversing the burner box and downdraft ventilation plenum through the center of the unit.

As shown in FIGS. 1, 2 and 3, the housing 11 can include a peripheral flange-forming member 17 providing an outwardly extending upper flange 17*a* surrounding the open top 14 and providing an upper surface of the countertop cooking unit. As shown in FIG. 3, the outwardly extending flange 17*a* of flange-forming member 17 is adapted to rest on the countertop 12 and support the countertop cooking unit recessed within the countertop 12. As shown in FIG. 1, the countertop cooking unit can be provided with a control box 18 attached to a peripheral wall of the burner box 13 and having an upper surface 18*a* carrying at least one control 19 for the heating units of the countertop appliance.

Figure 4:
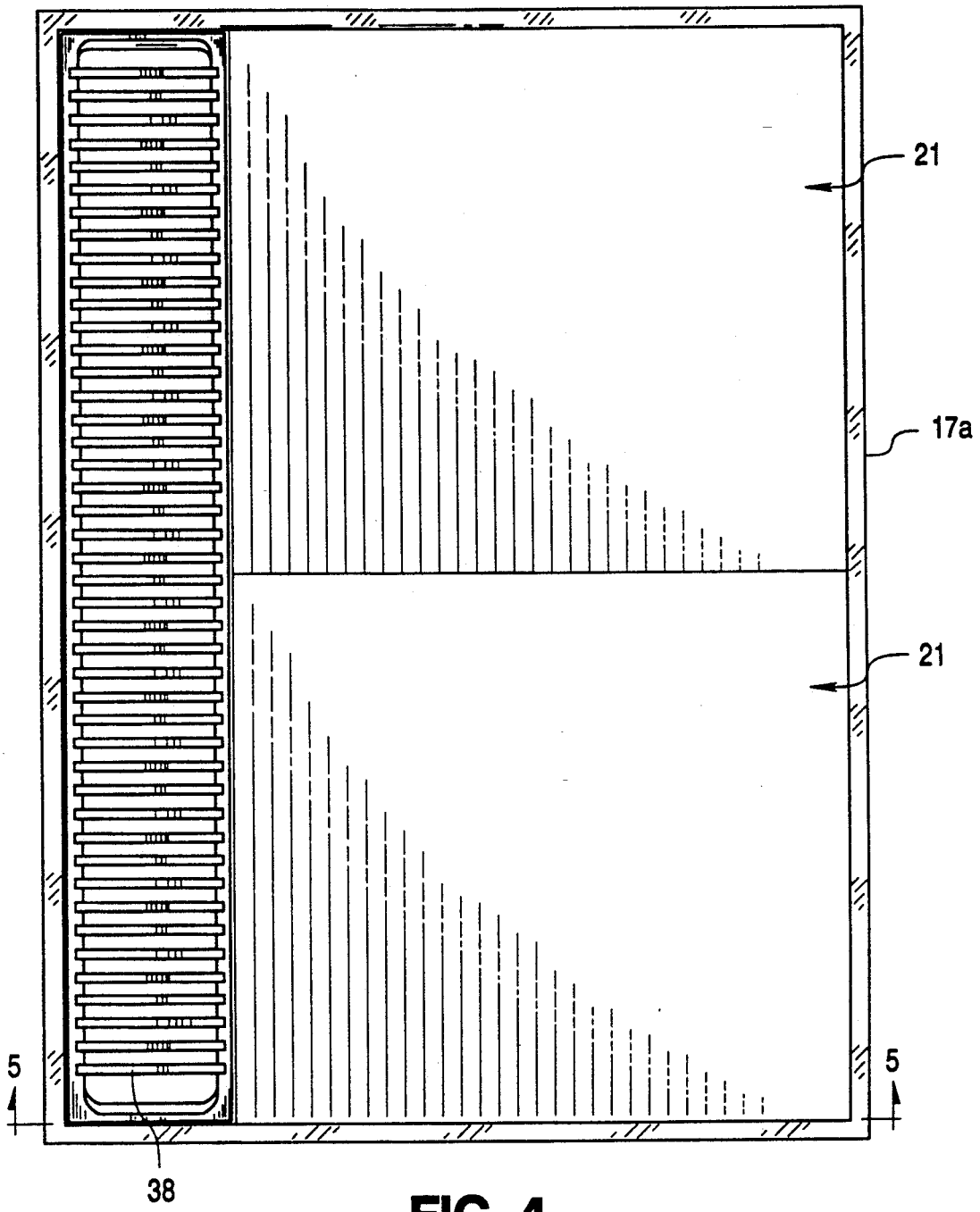
FIG. 4 is a top view of a countertop cooking appliance of the invention including covers for the heating unit.
Figure 5:
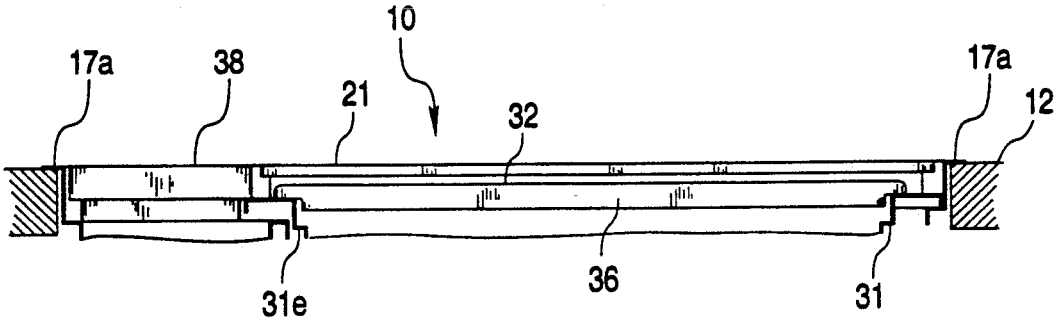
FIG. 5 is a cross-sectional view of the unit of FIG. 4 taken at a plane 5—5 of FIG. 4.

FIGS. 3–6 illustrate the manner in which the countertop cooking unit 10 provides an upper surface that is flush with the countertop 12. FIGS. 4 and 6 illustrate the flush upper surface. FIG. 4 illustrates a single unit including covers 21 for the heating unit(s) removably carried within the periphery 17 of the housing and providing an upper surface 21*a* (FIG. 5) that is level with the upper surface of the countertop 12. FIG. 6 illustrates the appearance of such a unit when converted for grilling without covers 21.

FIG. 2 is an exploded view showing the various elements that make up downdraft embodiments of the countertop cooking appliance of this invention. The basic parts making up a countertop cooking unit include the housing 11 including a burner box 13 and having an open top 14, a bottom 13*b* and peripheral walls 13*c*–13*f*, a downdraft ventilation plenum 15 adapted to be recessed below the open top 14 of the housing 11 and carried, at least in part, by the burner box 13. As shown in FIG. 1, these basic parts may be supplemented with the control box 18 adapted to be attached to one of the peripheral walls of the burner box, longitudinal wall 13*d* as shown in FIG. 2. As indicated above, the interior parts of the countertop cooking appliance of the invention indicated, bracketed by 30 in FIG. 2, are removably carried by the housing 11 and may be varied to provide different cooking operations or to convert the cooking appliance from surface-top cooking to grilling, by the means illustrated in FIG. 2.

In all of the embodiments of the invention, a removable drip pan 31 is provided. The removable drip pan 31 is recessed below the open top 14 of the housing within the burner box 13 and is removably carried by the housing 11 at its peripheral edges 31*a*. At least one heating unit, such as the surface burner unit 32 or the grilling unit bracketed by 33, is recessed and removably carried within the removable drip pan 31. In all embodiments, the upper surface of the countertop cooking appliance is flush with the countertop 12 as indicated by FIGS. 4, 5 and 6, respectively.

In the embodiment illustrated in FIG. 2, the housing 11 comprises a peripheral flange-forming member 17 with supporting surfaces 17*b* inside its peripheral walls, and the removable drip pan 31 engages the supporting surfaces 17*b* at its peripheral edges 31*a*. As further shown in FIG. 2, the bottom 13*b* of burner box 13 may be provided with an opening 13*g* to receive the plenum-forming member 15 of the downdraft ventilation system. The walls 15*a*–15*d* of plenum-forming member 15 extend through the opening 13*g* in the bottom 13*b* of the burner box 13 and the portions 15*d* of the walls of plenum-forming unit that extend above the bottom 13*b* of the burner box 13 have one or more air flow openings 15*g*. As shown in FIG. 2, the portion of wall 15*a* extending above plenum-supporting flange 15*h* is provided with four openings 15*g*.

As further shown in FIG. 2, the removable drip pan 31 comprises an outwardly extending flange 31*b* extending around its periphery. The outwardly extending flange 31*b* is provided with a plurality of distributed air flow openings 31*c*. The outwardly extending flange 31*b* of removable drip pan 31 engages the supporting surface 17*b* of housing 11 at its periphery. In the downdraft embodiments of FIGS. 1 through 6, operation of fan 16 will induce a flow of air 90 into the plenum-forming unit 15 through plenum air flow openings 15*g*, and this flow of air will be drawn through air flow openings 31*c* in the removable drip pan and thereby directed between the peripheral walls 13*c*–13*e* of the burner box of housing 11 and the peripheral walls of the removable drip pan 31, as shown in FIG. 3 (and FIG. 6) to reduce heat transfer from the interior parts 30 of the cooktop unit to the housing 11 and countertop 12. As indicated in FIG. 2, the plurality of distributed air openings are preferably distributed in the three sides of the outwardly extending flange 31*b* that will be adjacent to countertop (as also shown in FIG. 6). As further shown in FIGS. 2 and 3, the outwardly extending flange 31*b* of the drip pan can be provided with a plurality of downwardly extending feet 31*d* at the four corners of the peripheral edge 31*a* of drip pan 31. The engagement of the downwardly extending feet 31*d* with the supporting ledge 17*b* reduces the conductive heat transfer from the drip pan to the housing 11.

The grilling assembly 33, shown in FIG. 2, is used when the countertop cooking unit is used for grilling. The grilling assembly basically comprises a grill heater 34 and a removable grill pan liner 35, recessed and removably carried by drip pan 31 at its peripheral edge, and grates 36. The removable grill pan liner 35 includes internal surfaces adapted to removably carry grill heater 34 recessed within its periphery. As shown in FIG. 2, drip pan 31 has an interior ledge 31*e* formed in its peripheral walls and removable grill liner 35 has an outwardly extending flange 35*a* and corner flanges 35*b*. The outwardly extending flange 35*a* preferably interfaces with ledge 31*e* to prevent air flow therebetween. The outwardly extending corner flanges 35*b* of grill liner 35 are adapted to rest on the interior ledge 31*e* of the drip pan 31 to removably carry the grill pan liner 35 in the drip pan 31 and to reduce conductive heat transfer from the grill heater 34 and grill pan liner 35 to the drip pan 31, the housing 11 and the countertop 12.

Figure 8C:
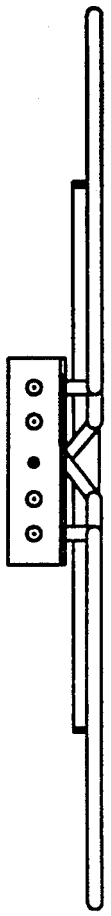
FIGS. 8A–8C include a top view, FIG. 8A, and a side view, FIG. 8B, and an end view, FIG. 8C, of a grilling heater.
Figure 8A:
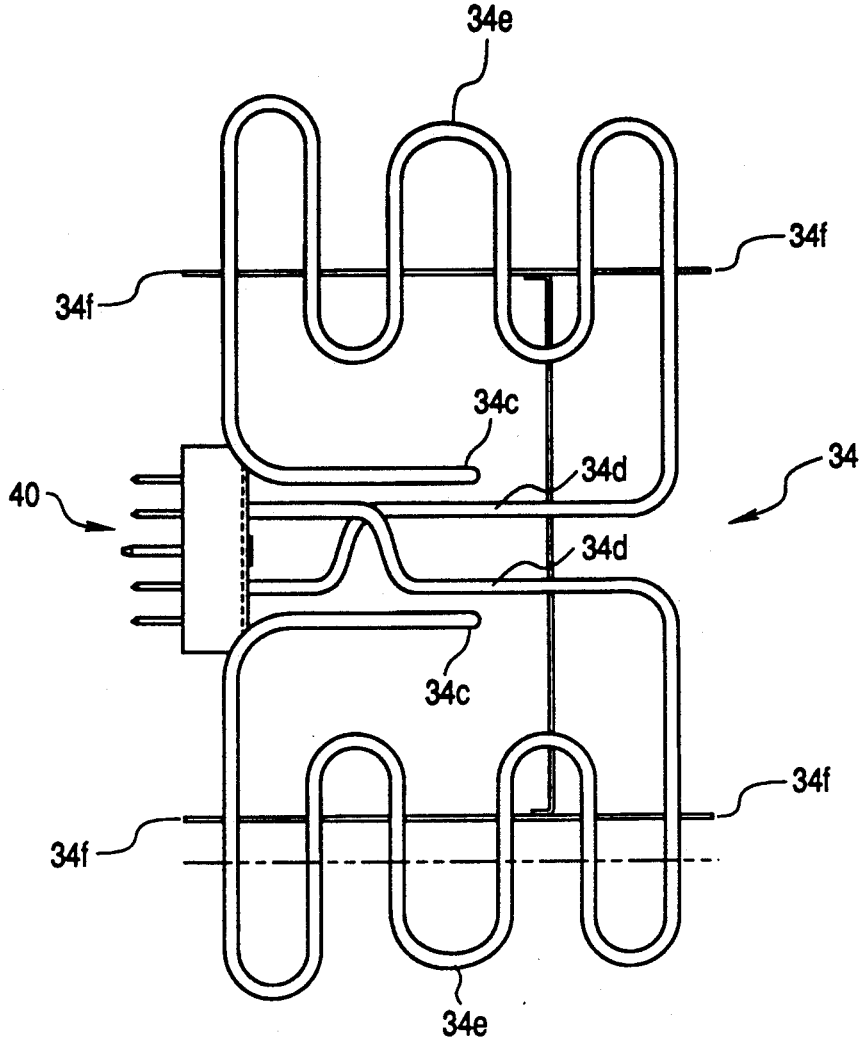
Figure 8B:
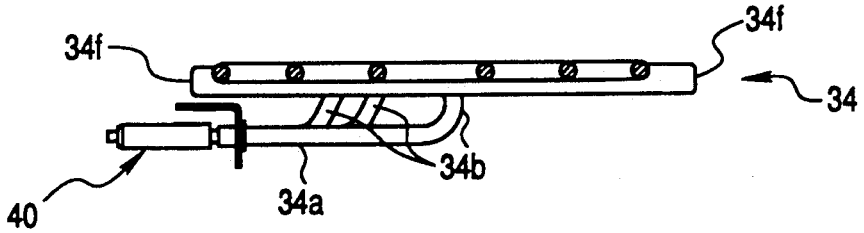

As shown in FIG. 8, the grill heater 34 is preferably formed by a serpentine electric heater lying substantially in a horizontal plane and connected through openings 35*f* and 31*f* in the side walls of the grill liner 35 and drip pan 31 to a connector 40, not shown, carried in opening 13*j* of housing 11 below the horizontal "heating" plane of the grill heater 34. As better shown in FIG. 8, the electrical strip heater includes inactive connection portions 34*a* extending from the connector 40 below the horizontal "heating" plane then upwardly through transition zones 34*b* to active heating portions 34*c*, 34*d*, at each end of the serpentine strip heating portion 34*e*, that are located closely adjacent to each other to provide uniform heating in the horizontal "heating" plane without "dead spots" adjacent the connector 40.

The grill assembly 33 includes upper grates 36 which rest on the outwardly extending flange 31*b* of drip pan 31 but inside of the air flow openings 31c to avoid obstruction of the cooling air flow induced into air flow openings 31c by operation of the downdraft ventilation system, as shown in FIGS. 3 and 6.

Thus, in a grilling unit of the invention, as shown in FIG. 2, the grill heater 34, grill liner 35 and drip pan 31 are nested within each other, and each is removably carried by the housing 11. The grill heater 34 has a plurality of supporting surfaces 34f extending from the serpentine heating portion 34e as shown in FIG. 8. The grill liner 35 has an interior ledge 35g and a plurality of supporting surfaces 35b extending from its periphery, and the drip pan 31 has an interior ledge 31e and a plurality of supporting surfaces 31d extending from its periphery, and the housing 11 has an interior ledge 17b. The supporting surfaces of the grill heater 34, grill liner 35 and drip pan 31 engage the interior ledges of the grill liner 35, drip pan 31 and housing 11, respectively, for removable support and reduced heat transfer from the grill heater 34 to the housing 11 and countertop 12.

The improvements in countertop cooking units represented by this invention include: (a) a drip pan recessed within and removably carried by the housing and burner box of the cooktop unit; (b) a drip pan removably carried by the housing and burner box with an outwardly extending flange, including a plurality of air flow openings to provide cooling air between the drip pan and the housing and burner box, for example, so that in downdraft embodiments operation of the downdraft ventilation means induces a flow of cooling air from above the cooktop unit between the walls of the drip pan and the burner box; (c) grilling units where the cooktop unit further comprises a removable grill liner recessed within and removably carried by a removable drip pan with a grilling heater removably carried by and within the removable grill liner; and further (d) a removable drip pan with an interior ledge and a removable grill liner with a plurality of corner flanges that rest upon the interior ledge of the drip pan to removably support the grill liner and reduce heat transfer from the grill liner to the removable drip pan.

It should be noted that not only do the air flow openings 31c of the removable drip pan provide a flow of cooling air between the drip pan and the burner box, in downdraft embodiments, they help exhaust cooking vapors and odors generated by the adjacent surface burners and grill unit (as indicated in FIG. 6).

As noted above and shown in FIG. 9, a further embodiment of a countertop cooking appliance 100 of the invention comprises housing 110 with an upwardly facing burner box 113 having an open top 114, a bottom 113b, front and rear faces 113c and 113e and two sides 113d and 113f defining its periphery, at least one heating unit 32 carried by the housing means and covers 21 for the heating unit 32 recessed within the open top 114 of the housing 110. The housing 110 of FIG. 9 embodiment is not adapted for downdraft ventilation. Control box 18, including elongated top 18a and carrying one or more controls 19 for the heating unit 32 can extend substantially along one side 113d of the housing 110 and provide, in combination with said covers 21, when the covers are supported overlying the heating unit, a substantially uninterrupted upper surface for the countertop cooking appliance, as shown in FIG. 10. The outwardly extending flange 117 of the housing 110 can comprise a trim strip 117a fastened to the burner box, running around the periphery of the burner box and overlaying the countertop. The control box 18 can also carry a trim strip 18b at its periphery that matches the trim strip 117a when the control box 18 is assembled on the side 113d of housing 110. The combined housing 110 and control box 18, and their matching and interfacing trim strips 117a and 18b, and covers 21 provide appliance 100 with an integrated decorative appearance.

The control box 18 can carry any number of controls 19 for the heating units and downdraft ventilation system. The control box can carry electronic modules using touch pads permitting the user to choose from any one of a plurality of preset fan speeds for the downdraft ventilation system. The electronic controls can provide any number of preselected temperature levels, and the countertop cooking appliance can be provided with food thermometers to display food temperature in 5-degree increments from 100°-500° F. at the upper surface of the control box. In the alternative, electromechanical control knobs and rotating controls can be used in the control box, as shown in FIG. 10, to control the heating units.

Figure 9:
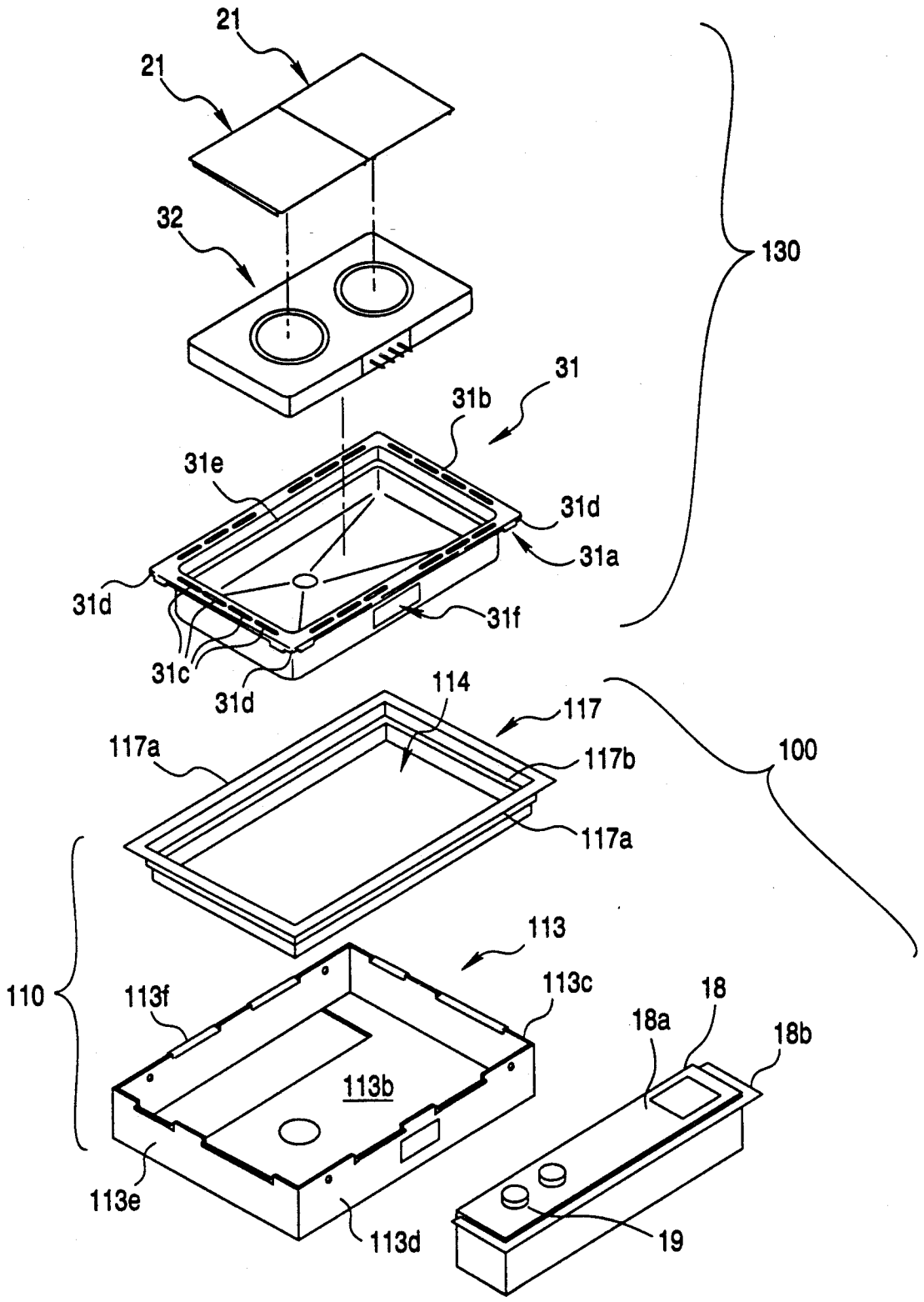
FIG. 9 is an exploded perspective view of a "single" updraft unit of the invention.
Figure 10:
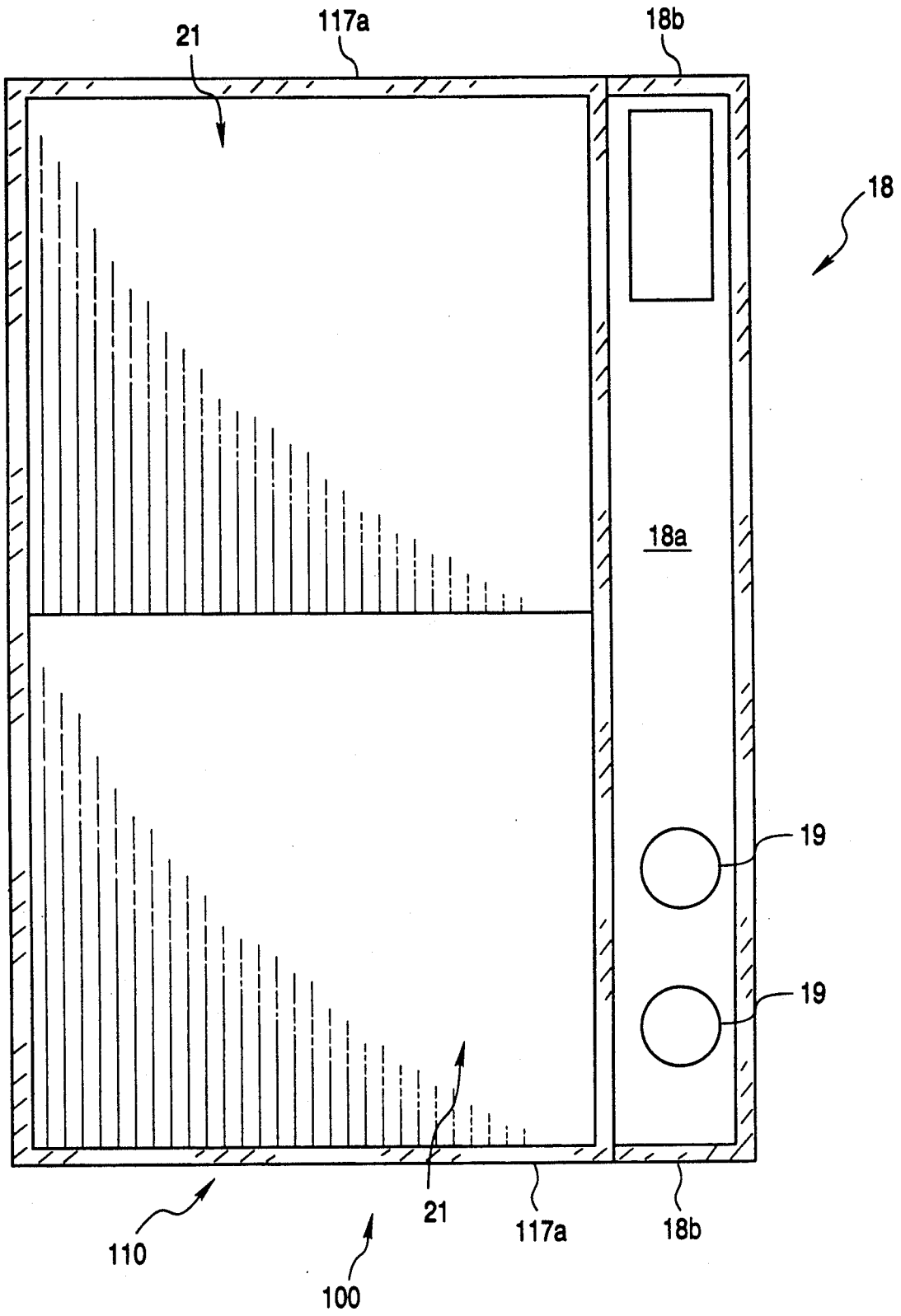
FIG. 10 is a top view of the countertop unit of FIG. 9.

The exploded view of FIG. 9 shows the various elements included in updraft embodiments of the countertop cooking appliance of this invention. The updraft countertop cooking unit 100 of FIG. 9 includes a housing 110 including a burner box 113 and having an open top 114, a bottom 113b and peripheral walls 113c-113f. As shown in FIGS. 9 and 10, the updraft countertop cooking unit 100 also includes a control box 18 adapted to be attached to one of the peripheral walls of the burner box, longitudinal wall 113d as shown in FIGS. 9 and 10. The interior parts of the countertop cooking appliance of the invention indicated, bracketed by 130 in FIG. 9, are removably carried by the housing 110 and may be varied to provide different cooking operations as described above.

Removable drip pan 31 is recessed below the open top 114 of the housing within the burner box 113 and is removably carried by the housing 110 at its peripheral edges 31a. At least one heating unit, such as the surface burner unit 32, is recessed and removably carried within the removable drip pan 31. The upper surface of the countertop cooking appliance 100 can be flush with a countertop 12 in the same manner as indicated in FIGS. 4, 5 and 6.

Housing 110 comprises a peripheral flange-forming member 117 with supporting surfaces 117b inside its peripheral walls, and the removable drip pan 31 engages the supporting surfaces 117b at its peripheral edges 31a. The removable drip pan 31 comprises an outwardly extending flange 31b extending around its periphery. The outwardly extending flange 31b is provided with a plurality of distributed air flow openings 31c. The outwardly extending flange 31b of removable drip pan 31 engages the supporting surface 117b of housing 110 at its periphery. In the updraft embodiment of FIGS. 9 and 10, a flow of air is induced by convection from the heating unit 32 and/or by an associated exhaust fan (not shown) adjacent or above the appliance, upwardly through air flow openings 31c in the removable drip pan and thereby directed between the peripheral walls 113c-113f of the burner box of housing 110 and the peripheral walls of the removable drip pan 31 to reduce heat transfer from the interior parts 130 of the cooktop unit to the housing 110 and countertop 12. As indicated in FIG. 9, the plurality of distributed air openings 31c are preferably distributed in the three sides of the outwardly extending flange 31b that will be adjacent to countertop. As further shown in FIGS. 2, 3 and 9, the outwardly extending flange 31*b* of the drip pan can be provided with a plurality of downwardly extending feet 31*d* at the four corners of the peripheral edge 31*a* of drip pan 31. The engagement of the downwardly extending feet 31*d* with the supporting ledge 17*b* reduces the conductive heat transfer from the drip pan 31 to the housing 110.

Thus, the invention not only provides a countertop cooking appliance that may be recessed within a countertop with a flush upper surface that is highly decorative, but also includes take-apart cooking elements that are easily removed from the countertop unit for cleaning by hand or in a dishwasher. In the grilling units, the grill pan liner not only provides a measure of thermal isolation between the grill heater and the countertop, but also generates smoke from juices leaving the foods being grilled that rises back up to flavor the food. The smoke can then be removed through the air flow openings at the periphery of the removable drip pan and the top of the downdraft ventilation system.

The invention provides a countertop cooking appliance adaptable and convertible to a wide variety of uses and available in a wide variety of configurations.

While a presently known best mode and preferred embodiments of the invention have been described above, the invention is not limited, as will be apparent to those skilled in the art, to the described best mode and preferred embodiments and shall be limited only by the scope of the invention as established by the prior art and the following claims.

We claim:

1. A countertop cooking unit, comprising:

a housing adapted to be supported by a countertop, including a burner box and having an open top level with the countertop, a bottom and peripheral walls;

at least one removable drip pan recessed below the open top of said housing within said burner box and removably carried by said housing at its peripheral edges;

a downdraft ventilation plenum recessed below the open top of said housing and carried, at least in part, by said burner box; and at least one heating unit recessed and removably carried within said removable drip pan, said countertop cooking unit being adapted thereby to provide an upper surface that is level with said countertop and removable interior parts.

2. The countertop cooking unit of claim 1 wherein said housing comprises a peripheral flange-forming member with supporting surfaces inside its peripheral walls, and said removable drip pan engages said supporting surfaces at its peripheral edges.

3. The countertop cooking unit of claim 1 wherein said burner box is provided with an opening in its bottom to receive said downdraft ventilation plenum, and said downdraft ventilation plenum comprises a plenum-forming unit with walls forming a plenum and extending through said opening in the bottom of said burner box.

4. The countertop cooking unit of claim 3 wherein said removable drip pan comprises an outwardly extending flange around its periphery, said outwardly extending flange is provided with a plurality of distributed air flow openings and engages at its periphery said housing to removably support said drip pan in said housing; a portion of the walls of said plenum-forming unit extend above the bottom of said burner box and have at least one air flow opening whereby a fan-induced flow of air into said plenum-forming unit is directed between the peripheral walls of said housing and the drip pan to reduce heat transfer to said housing.

5. The countertop cooking unit of claim 4 wherein said housing comprises a peripheral flange-forming member with an interior ledge; said outwardly extending flange of said drip pan rests on and is removably carried by said ledge; and said plurality of distributed air flow openings comprise openings formed in at least three sides of said outwardly extending drip pan flange.

6. The countertop cooking unit of claim 5 wherein said outwardly extending flange of said drip pan has a plurality of downwardly extending feet engaging said ledge to reduce conductive heat transfer from said drip pan to said housing.

7. The countertop cooking unit of claim 1 wherein said at least one heating unit comprises a grill heater, and said countertop cooking unit further comprises a removable grill pan liner recessed within and removably carried by said drip pan at its peripheral edge, said removable grill pan liner being adapted to removably carry said grill heater recessed within its periphery.

8. The countertop cooking unit of claim 7 wherein said drip pan has a ledge formed in its peripheral walls; said grill pan liner has outwardly extending corner flanges; and the outwardly extending corner flanges of said grill pan liner are adapted to rest on said ledge of said drip pan to removably carry said grill pan liner in said drip pan and to reduce heat transfer from said grill heater and grill pan liner to said drip pan and said housing.

9. The countertop cooking unit of claim 7 wherein said grill heater is formed by a serpentine electrical strip heater lying substantially in a horizontal plane, and said electrical strip heater is connected through openings in the side walls of said grill pan liner and said drip pan with an electrical connector below said horizontal plane, said electrical strip heater including inactive connection portions extending from said connector below the horizontal plane and then upwardly through transition portions to adjacent active heater portions at each end of said electrical strip heater, thereby providing uniform heat in the horizontal plane without dead spots adjacent said connector.

10. The countertop cooking unit of claim 1 further comprising a control box attached to a peripheral wall of said burner box and having an upper surface level with the open top of said housing and carrying at least one control for said at least one heating unit of said countertop cooking unit.

11. The countertop cooking unit of claim 1 further comprising at least one cover for said at least one heating unit, said at least one cover being removably carried within said housing and providing an upper surface that is level with said countertop.

12. In a grilling unit comprising a housing with means for supporting said housing by a countertop, a drip pan in said housing, a grill liner and a grilling assembly including a grill and a grill heater, the improvement wherein said housing includes an interior ledge and said grill heater, grill liner and drip pan are nested within each other and said drip pan is nested within and is freely and removably carried at its periphery by the interior ledge of said housing.

13. The grilling unit as in claim 12 wherein said gill liner is nested within and is freely and removably carried at its periphery by an interior ledge of said drip pan, and said grill heater is nested within and is freely and removably carried at its periphery by an interior ledge of said grill liner, said drip pan, grill liner and grill heater being easily dissembled by freely lifting one from the other.

14. In a countertop cooking unit comprising a burner box connected with a downdraft ventilation means, a drip pan within said burner box and at least one heating unit within said drip pan, the improvement wherein said drip pan includes an outwardly extending flange around its periphery including a plurality of air flow openings, and said drip pan is recessed within and removably carried within said burner box by said outwardly extending flange.

15. In a countertop cooking unit comprising a burner box connected with a downdraft ventilation means, a drip pan within said burner box and at least one heating unit within said drip pan, the improvement wherein said drip pan has an outwardly extending flange with a plurality of air flow openings and is removably carried by engagement of said outwardly extending flange with said burner box, and said burner box is connected with said downdraft ventilation means by an air flow opening below said outwardly extending flange of said drip pan, and said downdraft ventilation means induces a flow of cooling air from above said countertop cooking unit between the walls of said drip pan and said burner box.

16. The countertop cooking unit of claim 15 wherein said at least one heating unit is a grill heater, said countertop cooking unit further comprises a removable grill liner recessed within and removably carried by said drip pan, and said grill heater is removably carried by and within said removable grill liner.

17. The countertop cooking unit of claim 16 wherein said removable drip pan has an interior ledge and said removable grill liner has a plurality of feet that rest on the interior ledge of said drip pan to removably support said grill liner and reduce the heat transfer from said grill liner to said drip pan.

18. A cooking appliance, comprising:

housing means defining an upwardly facing burner box;

downdraft ventilation means associated with said housing means and having air inlet means at one side of said burner box;

drip pan means in said housing means and having a first side adjacent said one burner box side, said drip pan including a recessed central portion spaced above the bottom wall of said burner box defining an air flow space therebetween in air flow communication with said air inlet means, said drip pan means further including peripheral flange means having a plurality of air intake apertures located along the remaining sides of said drip pan means, said apertures providing air flow communication with said air flow space and a thermal break between said drip pan means and said housing means;

grate means overlying said drip pan means for supporting items to be cooked; and heater means in said drip pan means below said grate means for heating said items to be cooked, wherein operation of said downdraft ventilation means establishes an air flow into said air flow space around the periphery of said cooking appliance to draw cooling air flow and cooking by-products through said air intake apertures and said air inlet means for reducing heat transfer to said housing means, and exhausting cooking by-products.

19. A countertop cooking unit, comprising:

a housing adapted to be supported by a countertop, said housing including a burner box and having an open top level with the countertop, a bottom and peripheral walls, said housing further including an interior ledge;

at least one removable drip pan recessed below the open top of said housing within said burner box and removably carried by said interior ledge of said housing at its peripheral edges; and at least one heating unit recessed and removably carried within said removable drip pan, said countertop cooking unit being adapted thereby to provide an upper surface that is level with said countertop, and interior parts that are easily disassembled by freely lifting one from the other.

20. The countertop cooking unit of claim 19 wherein said housing comprises a peripheral flange-forming member with supporting surfaces forming said interior ledge inside its peripheral walls, and said removable drip pan engages said supporting surfaces at its peripheral edges.

21. The countertop cooking unit of claim 19 further comprising a control box attached to a peripheral wall of said burner box and having an upper surface level with the open top of said housing and carrying at least one control for said at least one heating unit of said countertop cooking unit.

22. The countertop cooking unit as in claim 19 wherein said drip pan includes an interior ledge and said at least one heating unit is removably carried by said interior ledge of said drip pan.

23. In a grilling unit, including a housing with means for supporting said housing by a countertop, a drip pan in said housing, a grill liner and a grilling assembly including a grill and a grill heater, the improvement comprising said grill heater, grill liner and drip pan being nested within each other, said grill heater including a heating unit and a plurality of supporting surfaces extending from said heating unit, said grill liner including at interior ledge and a plurality of supporting surfaces extending from its periphery, said drop pan including an interior ledge and a plurality of supporting surfaces extending from its periphery, and said housing including an interior ledge, the supporting surfaces of said grill heater, grill liner and drip pan engaging the interior ledges of said grill liner, drip pan and housing, respectively, for removably supporting said grilling assembly within said housings for reducing heat transfer from said grilling assembly to said housing.

24. A countertop cooking unit, comprising:

a housing adapted to be supported by a countertop, said housing including a burner box and having an open top level with the countertop, a bottom, peripheral walls, and a peripheral flange-forming member with supporting surfaces inside its peripheral walls;

at least one removable drip pan recessed below the open top of said housing within said burner box and removably carried by said housing at its peripheral edges, said removable drip pan comprising an outwardly extending flange at its periphery forming a plurality of distributed air flow openings and engaging said supporting surfaces of said housing at its peripheral edges to removably support said drip pan in said housing; and at least one heating unit recessed and removably carried within said removable drip pan, said countertop cooking unit being adapted thereby to provide an upper surface that is level with said countertop and removable interior parts, and an induced flow of air is directed between the peripheral walls of said housing and said drip pan to reduce heat transfer to said housing.

25. The countertop cooking unit of claim 24 wherein said outwardly extending flange of said drip pan rest on and is removably carried by said ledge; and said plurality of distributed air flow openings comprise openings formed in at least three sides of said outwardly extending drip pan flange.

26. The countertop cooking unit of claim 25 wherein said outwardly extending flange of said drip pan has a plurality of downwardly extending feet engaging said ledge to reduce conductive heat transfer from said drip pan to said housing.

27. The countertop cooking unit of claim 26 wherein said drip pan has a ledge formed in its peripheral walls; and said heating unit has outwardly extending surfaces adapted to rest on said ledge of said drip pan to removably carry said heating unit in said drip pan and to reduce heat transfer from said heating unit to said drip pan and said housing.

28. The countertop cooking unit, comprising:

a housing adapted to be supported by a countertop, said housing including a burner box and having an open top level with the countertop, a bottom and peripheral walls;

at least one removable drip pan recessed below the open top of said housing within said burner box and removably carried by said housing at its peripheral edges;

at least one heating unit recessed and removably carried within said removable drip pan; and at least one cover for said at least one heating unit, said at least one cover being removably carried within said housing and providing an upper surface that is level with said countertop, said countertop cooking unit being adapted thereby to provide an upper surface that is level with said countertop, and removable interior parts.

* * * * *